US008189844B2

(12) United States Patent
Dolberg

(10) Patent No.: US 8,189,844 B2
(45) Date of Patent: May 29, 2012

(54) HEADWEAR MOUNTED HEADPHONE CARRIER

(76) Inventor: Terry L. Dolberg, Urbandale, IA (US)

( * ) Notice: Subject to any disclaimer, the term of this patent is extended or adjusted under 35 U.S.C. 154(b) by 612 days.

(21) Appl. No.: 12/352,651

(22) Filed: Jan. 13, 2009

(65) Prior Publication Data

US 2009/0180658 A1 Jul. 16, 2009

Related U.S. Application Data

(60) Provisional application No. 61/020,769, filed on Jan. 14, 2008.

(51) Int. Cl.
*H04R 1/02* (2006.01)

(52) U.S. Cl. ..... 381/376; 381/388; 2/209.13

(58) Field of Classification Search ..... 381/370, 381/374, 376, 378, 388; 2/209.12, 209.13; 181/129, 130
See application file for complete search history.

(56) References Cited

U.S. PATENT DOCUMENTS 4,527,982 A * 7/1985 Salzman et al. ..... 434/258
4,776,044 A * 10/1988 Makins ..... 2/209.13
4,858,248 A * 8/1989 Goldsmith et al. ..... 2/209.13
5,117,464 A 5/1992 Jones et al.
5,287,559 A * 2/1994 Christiansen et al. ..... 2/181
5,329,592 A * 7/1994 Altman ..... 381/379
5,410,746 A * 4/1995 Gelber ..... 455/344
5,438,698 A * 8/1995 Burton et al. ..... 455/351
5,584,076 A * 12/1996 Armstrong ..... 2/195.2
5,881,160 A * 3/1999 Sheppard ..... 381/376
5,881,390 A * 3/1999 Young ..... 2/209.13
6,013,007 A 1/2000 Root et al.
D501,979 S * 2/2005 Lundgren ..... D2/866
6,970,691 B2 * 11/2005 Thompson ..... 455/344
7,044,615 B2 5/2006 Gesten
2004/0204207 A1 * 10/2004 Parker ..... 455/575.2
2006/0185062 A1 * 8/2006 Peng et al. ..... 2/209.13
2006/0251283 A1 * 11/2006 Yeh ..... 381/388
2007/0226876 A1 * 10/2007 Foust et al. ..... 2/171
2007/0248238 A1 * 10/2007 Abreu ..... 381/381

* cited by examiner

*Primary Examiner* — Jeremy Luks
(74) *Attorney, Agent, or Firm* — McKee, Voorhees & Sease, P.L.C.

(57) ABSTRACT

A headphone carrying device comprises a thin, flexible strip of material which supports the wires for conventional ear bud style headphones. The strip can be quickly and easily inserted inside a cap or hat, between the body and headband of the hat or cap. The device is fully hidden from view when the hat or cap is worn and maintains the wires adjacent the back of the person's head, without the wires hanging or dangling loosely. Alternatively, the device can be attached to the back of a bike helmet or other headgear using adhesive, Velcro fasteners, or other connectors. The device is lightweight, fits all sizes of hats, caps and headgear, and does not interfere with the normal wearing of the hat, cap or headgear.

11 Claims, 7 Drawing Sheets

HEADWEAR MOUNTED HEADPHONE CARRIER

CROSS-REFERENCE TO RELATED APPLICATIONS

This application claims priority under 35 U.S.C. §119(e) to provisional application Ser. No. 61/020,769 filed Jan. 14, 2008, herein incorporated by reference in its entirety.

FIELD OF THE INVENTION

The invention is directed to a carrier device to support wires of an audio headphone on a hat, cap or helmet adjacent to, at or near the back of a person's head.

BACKGROUND OF THE INVENTION

Many different types of electronic devices exist which allow a person to store and play selected music, such as MP3 players, Ipod™ players, ZUNE™ players, and the like. These devices are used with headphones, and include a port for receiving the headphone jack. Various styles of headphones can be used with these music players. One popular headphone style is earphone buds, which are small and light weight so as to fit into the ear easily and comfortably. A wire extends from the headphone jack and splits to each of the earphone buds.

The music player may be strapped to the person, particularly for use during physical activities, such as running, or other activities, whether indoors or out of doors. However, the headphone wires normally hang loose from the music player to the ear pieces. Such loose wires may become snagged, may be a distraction to the person wearing the headphones, or otherwise interfere with an activity. For example, a person who jogs while wearing such headphones often has the discomfort of the wires bouncing against their face or neck.

Therefore, a primary objective of the present invention is the provision of a device for holding headphones in a hat or cap worn by a person listening to music from a portable music player.

Another objective of the present invention is the provision of a headphone carrier which can be removably installed on a hat, helmet, headband, or other piece of headgear so as to securely support earphones connected to a portable music player.

A further objective of the present invention is the provision of a device for supporting headphone wires adjacent the back of a person's head.

Yet another objective of the present invention is the provision of a headphone carrier which fits in a hat so as to be hidden from view when the hat is worn.

Still another objective of the present invention is the provision of a device mounted on a piece of headgear to support headphone wires without the wires dangling loosely.

Another objective of the present invention is the provision of a headphone carrier removably mounted in a hat so as to allow the hat to be worn in any manner.

A further objective of the present invention is the provision of a headphone carrier consisting of a thin strip of material which fits between the headband and body of a cap.

Still another objective of the present invention is the provision of a headphone carrier installed in a hat and having a recess to accommodate a ponytail or similar hair projection or styling.

Still another objective of the present invention is the provision of a headphone carrier which is lightweight and useful on any size hat, cap or the like.

Another objective of the present invention is the provision of a headphone carrier which is economical to manufacture and durable and safe in use.

These and other objectives will become apparent from the following description of the invention.

SUMMARY OF THE INVENTION

The invention is directed towards a lightweight, simple device to which headphone wires are quickly and easily mounted, with the device then being removably mounted to a cap, hat, helmet or headband so as to support the earpieces of the headphone by a person wearing the headgear while listening to music from a portable music player or any portable audio device.

The headphone carrier device of the present invention comprises a thin, flexible material having a plurality of slots or notches to receive the headphone wires extending to the ear buds. The strip also has an opening through which the headphone wire leading to the jack can be inserted. After the wires are secured on the strip, the strip can be mounted inside the cap or hat, between the headband and the body of the hat or cap. In this preferred configuration, the strip is fully hidden from view when the hat or cap is worn by a person. The strip holds the wires in a position adjacent the back of the person's head, without hanging loosely. The ear buds are free to be placed in the person's ears for audio listening. The strip is flexible and will fit into any size hat. The strip may also include a recess or notch to accommodate a ponytail or styled hairdo. In an alternative embodiment, the strip can be mounted to the outside of a helmet using Velcro or other adhesive fasteners. Similarly, the device can be mounted on the back of a headband or visor to be worn by the person.

DETAILED DESCRIPTION OF THE DRAWINGS

Figure 1:
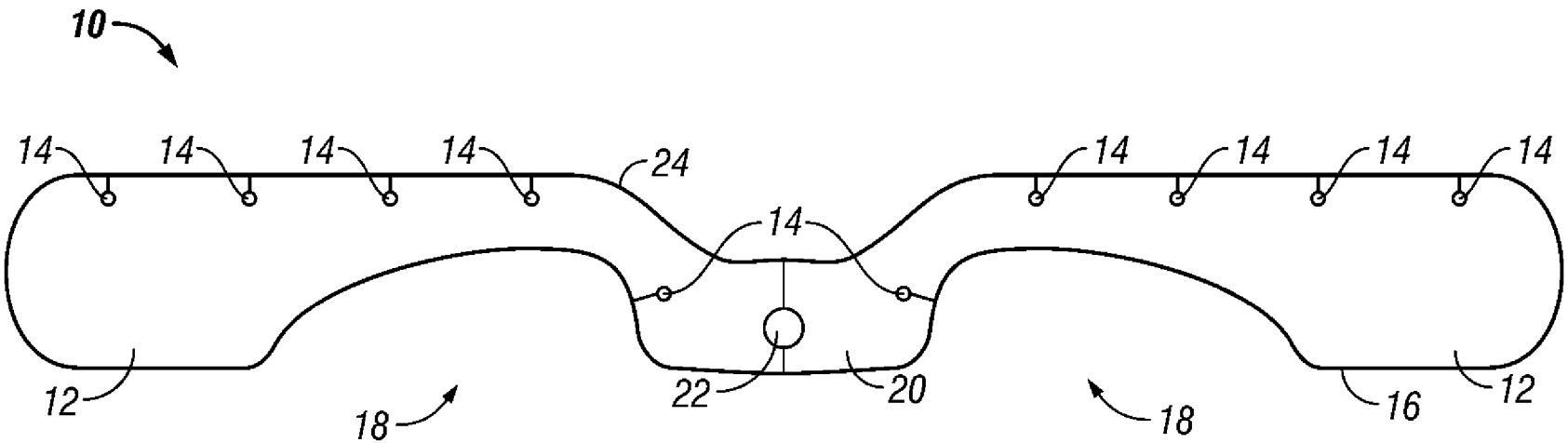
FIG. 1 is an elevation view of the headphone carrier device of the present invention.
Figure 2:
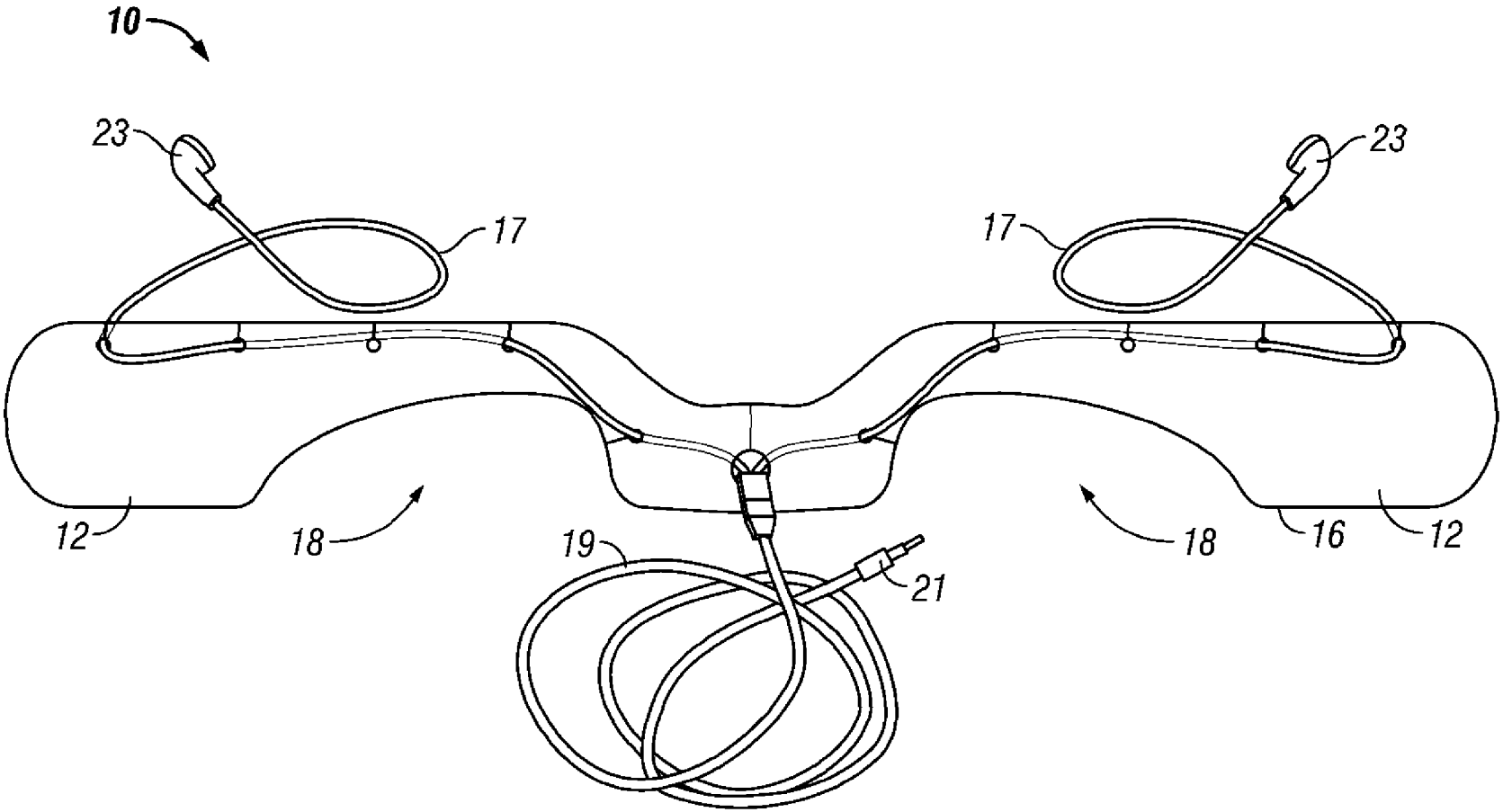
FIG. 2 shows the device with a set of headphones mounted thereon.
Figure 3:
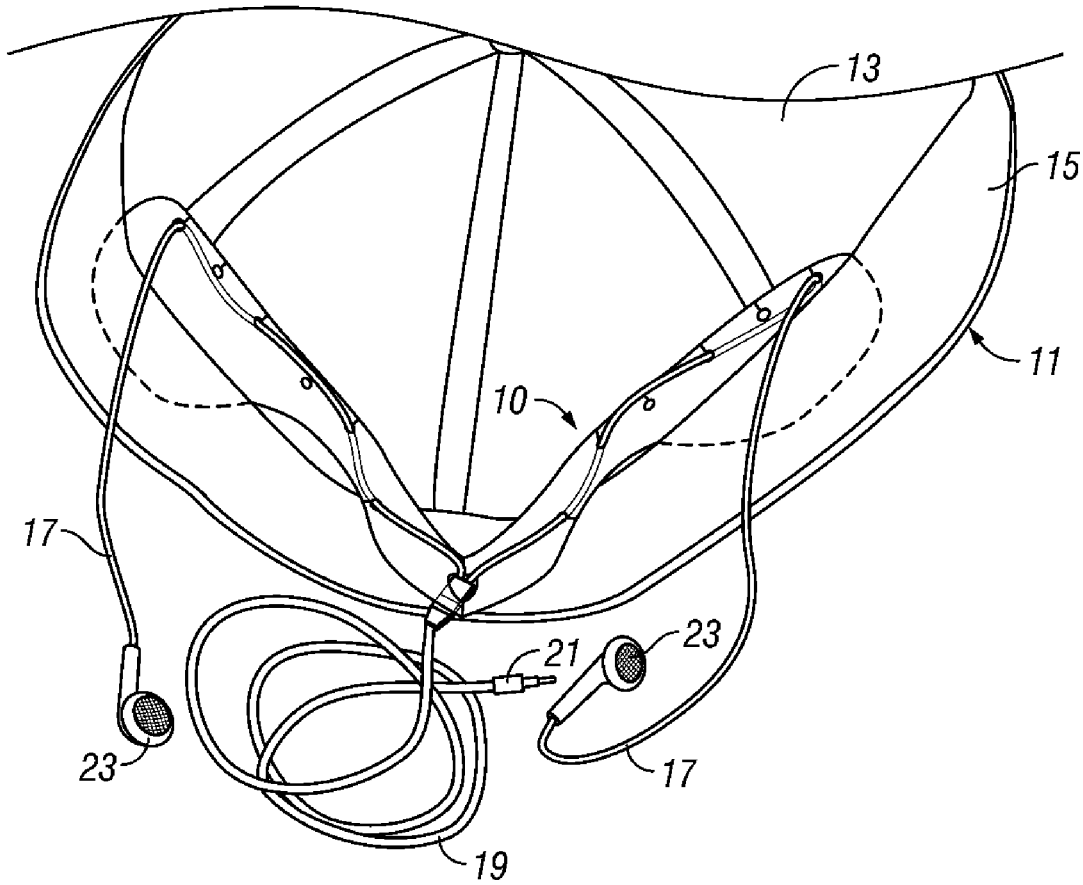
FIG. 3 shows the device with the headphones mounted on a ball hat.

The headphone carrying device 10 of the present invention is preferably formed from a thin piece of flexible material, such as plastic. The device 10 is elongated with opposite ends 12 which, in one preferred use, are adapted to be received inside a hat, cap, or skullcap or other piece of headwear 11, in a slot or space between the body 13 of the cap and the inner headband 15 or sweatband, as best seen in FIG. 3. The device 10 includes a plurality of slots 14 adapted to receive and retain the headphone wires 17, as best seen in FIG. 2. The lower edge 16 of the device 10 has a pair of recesses 18 in the form of notches or cutouts which allow a central portion 20 of the device to reside inside or inward from the headband 15 of the hat 11, as seen in FIG. 3. Thus, the ends 12 are behind the headband 15, while the central portion 20 is in front of the headband 15. A hole 22 in the center portion 20 allows the headphone wires 17 to be threaded therethrough for support, as best seen in FIG. 2. A cutout 24 on the upper edge of the device 10 allows a ponytail to extend out the back of a ball hat 11.

Figure 4:
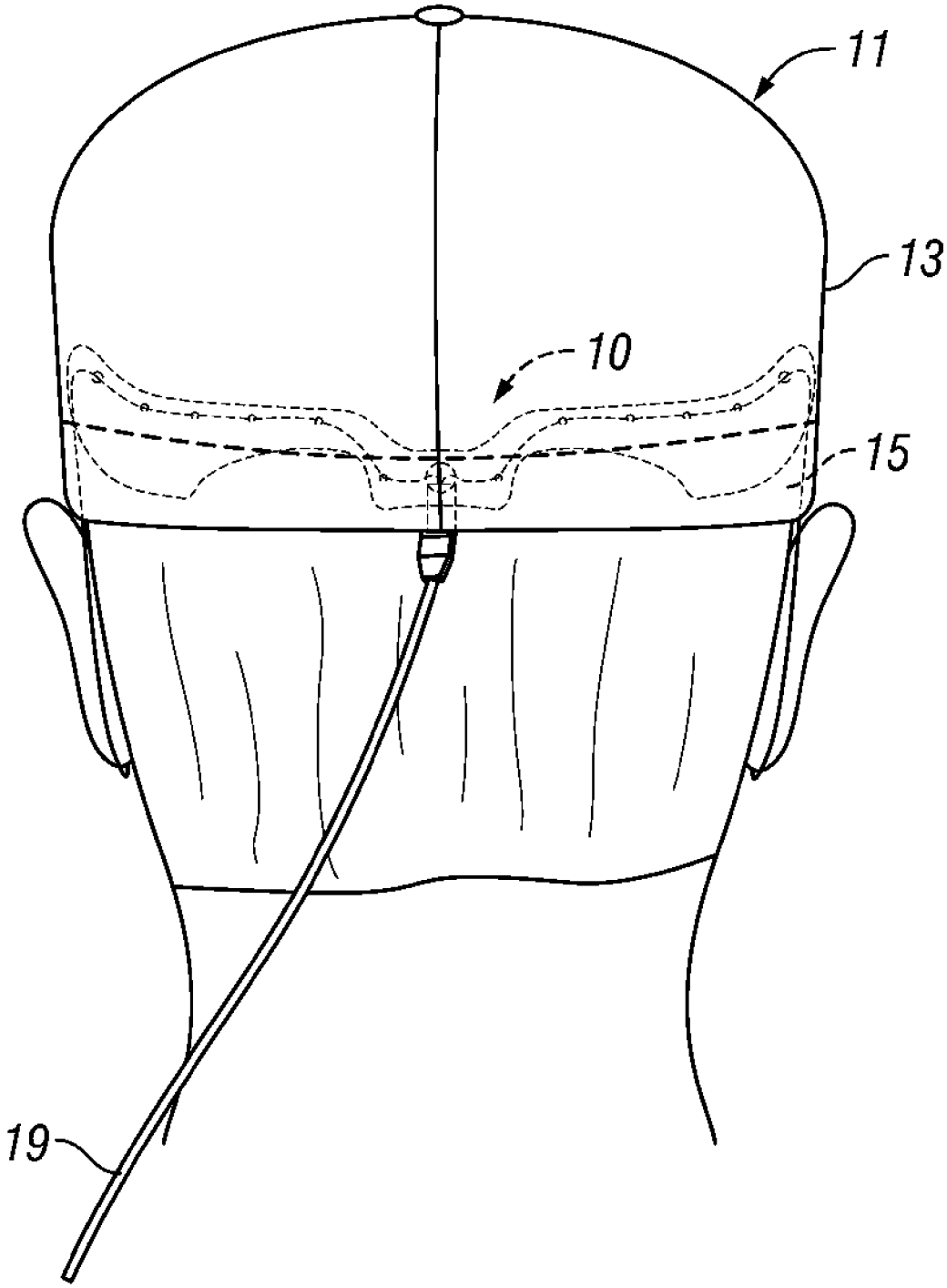
FIGS. 4 and 5 are back and side views, respectively, a hat having the headphone carrying device mounted therein, as worn by a person.
Figure 5:
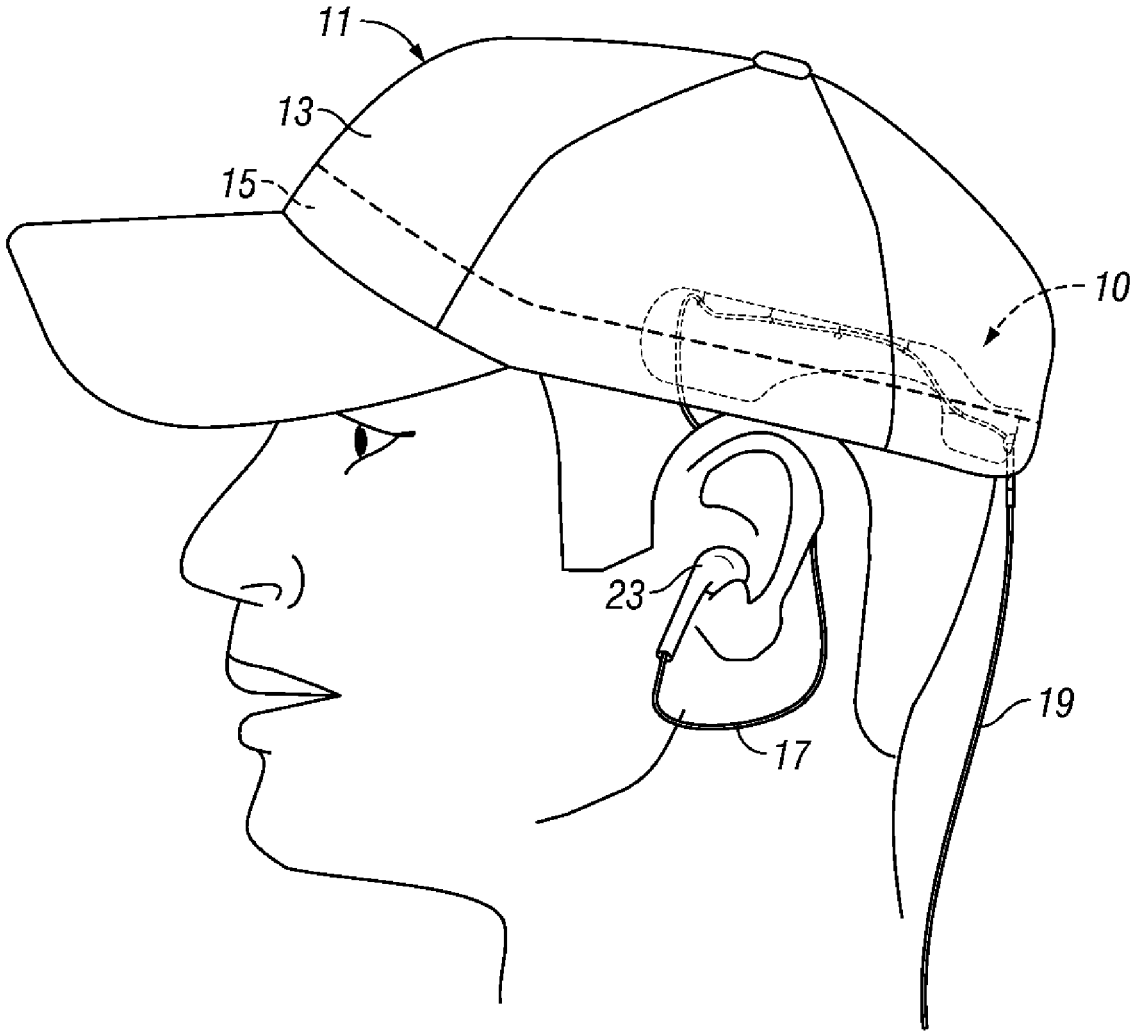

In use, the headphone wires 17 are quickly and easily threaded into the slots 14 of the device 10. The device 10 is then positioned inside the hat or cap 11, with the ends 12 of the device between the body 13 and headband 15 of the hat 11, as shown in FIG. 2. As seen in FIGS. 4 and 5, when the hat 11 is worn with the device 10 installed, the primary headphone wire 17 from the headphone jack 21 extends to the back of the hat 11, with the split earpiece wires 19 held in the slots or notches 14, thereby allowing the ear buds 23 to be easily placed in the person's ears on opposite sides of the hat 11. The device 10 is fully hidden from external view when mounted between the body 13 and headband 15 of the hat 11.

Figure 6:
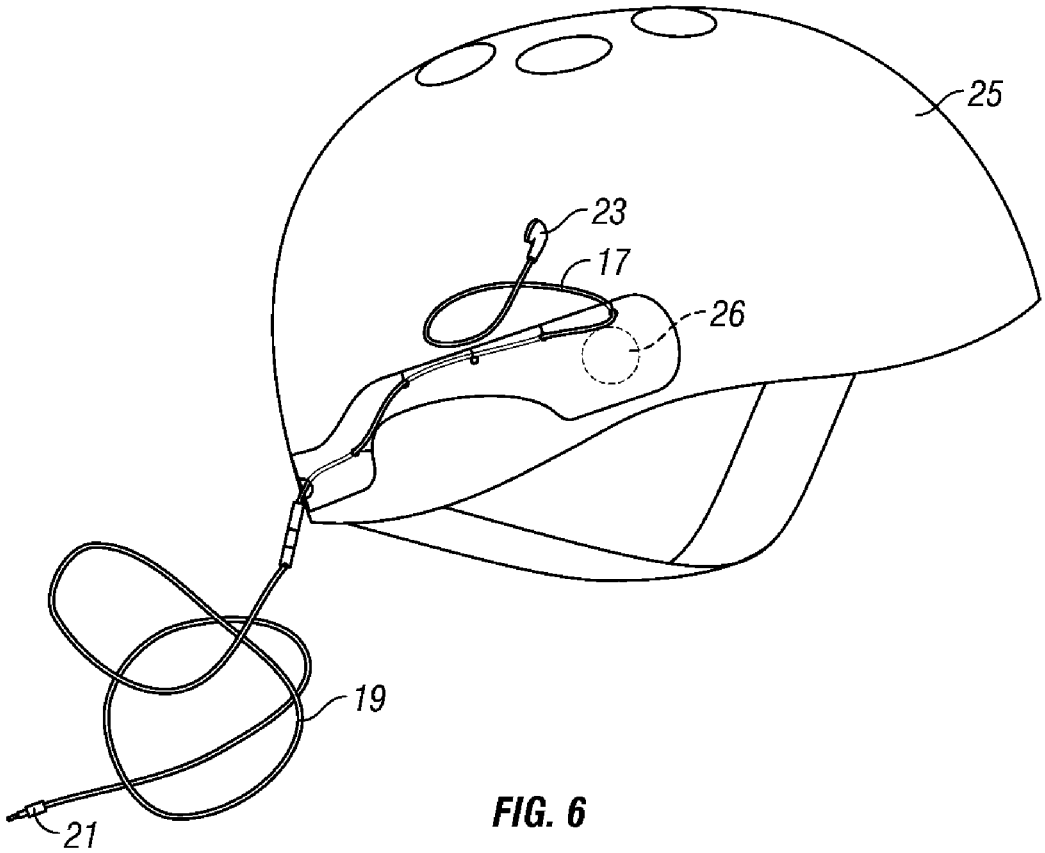
FIG. 6 shows the device and headphones mounted to a bike helmet.
Figure 7:
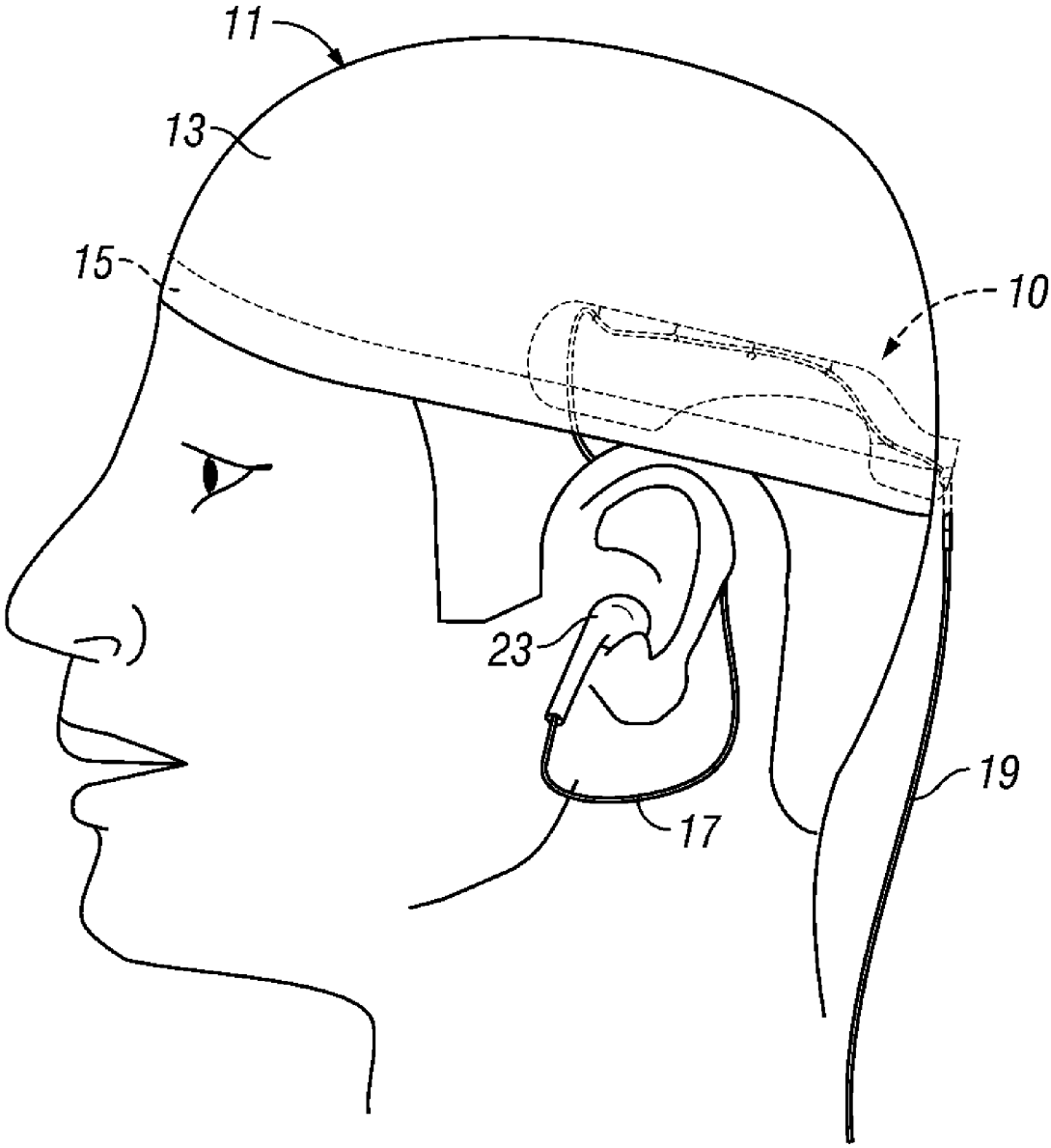
FIG. 7 shows the device and headphones mounted to a skull cap.

The device 10 may also be used on other headgear, such as a bike helmet 25 shown in FIG. 6. Device 10 may be attached to the helmet 25 in any convenient manner, such as adhesive or Velcro fasteners 26, which allow the device 10 to be removably mounted to the helmet 25. In another use, the device 10 can be mounted on a head sweatband or visor, in a manner similar to use on the helmet 25.

It is noted, that the device 10 of the present invention does not carry or support the music player, but rather carries and supports the headphones which are connected to the player. The location or placement of the player may be anywhere the listener desires, such as strapped to an arm, or slipped into a shirt pocket. The headphones, hats, caps and other headgear are convention.

It is understood that the device 10 may take shapes other than that shown in the drawings. The device 10 will fit any size hat or headgear, and does not interfere with normal wearing of the hat or headgear.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A device for holding headphones in a hat, the hat having a body with a perimeter headband, the device comprising:

a flexible member;

the member having opposite ends and a plurality of spaced apart slots for removably receiving and retaining wires of the headphones; and the ends of the member being removably sandwiched between the headband and the body of the hat so as to support the headphones on the hat.

2. The device of claim 1 wherein the member is a piece of thin, plastic material.

3. The device of claim 1 wherein the member is an elongated, single layer, flat strip with opposite front and rear sides, and the slots extending through the strip from front to back.

4. The device of claim 1 wherein the member has a central portion and a pair of notches formed in a lower edge on each side of the central portion whereby the central portion is forward of the headband, with the notches extending over the headband.

5. The device of claim 1 wherein the member is reversibly mountable on the headband.

6. The device of claim 1 wherein the member has opposite ends and a hole located substantially centered between the opposite end through which a headphone wire is threadable.

7. The device of claim 1 wherein an upper edge of the member includes a recess through which hair extends.

8. The device of claim 1 wherein the member is fully hidden within the hat when the hat is worn.

9. The device of claim 1 wherein the slots reside above the headband when the member is installed on the hat.

10. The device of claim 1 wherein the member has an upper edge and the slots are formed in the upper edge.

11. A device for holding headphones in a hat, the hat having a body with a perimeter headband, the device comprising:

a flexible member having opposite ends;

the member having slots for receiving and retaining wires of the headphones;

the ends of the member being adapted to fit between the headband and the body of the hat so as to support the headphones on the hat; and the member having upper and lower edges, with a central portion and a pair of notches formed in the lower edge on each side of the central portion whereby the opposite ends are between the headband and the hat body and the central portion is forward of the headband, with the notches extending over the headband.

* * * * *